US007741233B2

(12) United States Patent
Sasser et al.

(10) Patent No.: US 7,741,233 B2
(45) Date of Patent: Jun. 22, 2010

(54) FLAME-RETARDANT TREATMENTS FOR CELLULOSE-CONTAINING FABRICS AND THE FABRICS SO TREATED

(75) Inventors: Kimila C. Sasser, Cowpens, SC (US); Shulong Li, Spartanburg, SC (US); Zeb W. Atkinson, Spartanburg, SC (US); Richard A. Mayernik, Mauldin, SC (US)

(73) Assignee: Milliken & Company, Spartanburg, SC (US)

( * ) Notice: Subject to any disclaimer, the term of this patent is extended or adjusted under 35 U.S.C. 154(b) by 880 days.

(21) Appl. No.: 11/503,006

(22) Filed: Aug. 10, 2006

(65) Prior Publication Data

US 2008/0038973 A1 Feb. 14, 2008

(51) Int. Cl.
*B32B 27/12* (2006.01)

(52) U.S. Cl. ..... 442/136

(58) Field of Classification Search ..... 442/134, 442/136, 138, 141, 142, 143, 144, 145
See application file for complete search history.

(56) References Cited

U.S. PATENT DOCUMENTS

| | | | | |
|---|---|---|---|---|
| 3,900,664 | A | 8/1975 | Miller | 442/142 |
| 4,035,542 | A | 7/1977 | Rosenthal et al. | 442/202 |
| 4,078,101 | A | 3/1978 | Cole | 427/341 |
| 4,092,108 | A | 5/1978 | Valko et al. | 8/194 |
| 4,145,463 | A | 3/1979 | Cole | 427/337 |
| 4,151,322 | A | 4/1979 | Rosenthal et al. | 442/197 |
| 4,154,890 | A | 5/1979 | Wagner | 442/71 |
| 4,311,855 | A | 1/1982 | Cole et al. | 564/12 |
| 4,419,401 | A | 12/1983 | Pearson | 442/142 |
| 4,494,951 | A | 1/1985 | Cole et al. | 8/195 |
| 4,513,042 | A | 4/1985 | Lumb | 428/95 |
| 4,732,789 | A | 3/1988 | Hauser et al. | |
| 4,868,041 | A | 9/1989 | Yamagishi et al. | 442/191 |
| 4,909,805 | A | 3/1990 | Smith | 8/127.1 |
| 4,920,000 | A | 4/1990 | Green | 428/288 |
| 5,223,334 | A | 6/1993 | Green | 428/225 |
| 5,356,700 | A | 10/1994 | Tanaka et al. | 442/199 |
| 5,468,545 | A | 11/1995 | Fleming et al. | 428/259 |
| 5,480,458 | A | 1/1996 | Fleming et al. | |
| 5,506,042 | A | 4/1996 | Ichibori et al. | 442/414 |
| 5,759,207 | A | 6/1998 | Green | 8/115.7 |
| 5,876,849 | A | 3/1999 | Green | 428/359 |
| 5,928,971 | A | 7/1999 | Ellis et al. | 442/76 |
| 6,626,964 | B1 | 9/2003 | Lunsford et al. | 8/531 |
| 2003/0228812 | A1 | 12/2003 | Stanhope et al. | 442/49 |
| 2005/0085145 | A1 | 4/2005 | Fang et al. | 442/95 |

FOREIGN PATENT DOCUMENTS

| | | | |
|---|---|---|---|
| EP | 0 688 898 | A | 12/1995 |
| EP | 0 976 335 | A | 2/2000 |
| GB | 2 271 787 | A | 4/1994 |
| WO | WO 01/98569 | A | 12/2001 |

OTHER PUBLICATIONS

International Search Report, Jul. 27, 2007, PCT/US2007/016915.

*Primary Examiner*—Arti Singh-Pandey

(57) ABSTRACT

Provided herein are several inventive fabrics having warp yarns and fill yarns, where the warp yarns preferably are an intimate blend of synthetic and cellulosic fibers and where the fill yarns are preferably a patternwise arrangement of synthetic and cellulosic yarns. Such fabric possesses sufficient cellulosic content (i.e., at least 45% by weight) to be easily rendered flame retardant, while simultaneously possessing sufficient synthetic content (i.e., at least 30% by weight) to be abrasion resistant and long-lasting. In one embodiment, the subject fabrics are treated with one or more flame retardant chemicals, typically in the presence of ammonia gas. In a second embodiment, the subject fabrics are coated on one side with an elastomeric composition into which a flame retardant compound has been incorporated. In yet another embodiment, the subject fabrics are both treated and coated to achieve flame retardance.

12 Claims, No Drawings

FLAME-RETARDANT TREATMENTS FOR CELLULOSE-CONTAINING FABRICS AND THE FABRICS SO TREATED

TECHNICAL FIELD

The present disclosure is directed to chemical treatments and coatings used to provide durable flame retardant properties to cellulose-containing fabrics and to the fabrics so treated and/or coated. The fabrics described herein contain at least 30% synthetic content to preserve the desired strength characteristics of the fabric and at least 45% cotton content to achieve the desired degree of flame retardance.

In one embodiment, the subject fabrics are treated with a durable phosphorous flame retardant chemical in the presence of ammonia to impart flame retardant properties to the cotton components of the fabric. In a second embodiment, one side of the fabric is coated with an elastomeric coating into which a brominated flame retardant compound has been incorporated. Other embodiments and variations will be described herein.

BACKGROUND

Historically, it has been an objective of the textile industry to produce flame retardant fabrics for a variety of end uses, including apparel and uniform fabrics. To date, these efforts have been largely focused on cellulosic (that is, cotton) fabrics, which are readily made flame retardant by the addition of phosphorous-based flame retardant chemicals. However, cotton fabrics exhibit deficiencies in terms of durability, abrasion resistance, and drying time that make them unsuitable for a number of applications, including, for example, uniform and protective garments. Users of such specialized uniform and protective fabrics expect those fabrics to be flame retardant, long-lasting, abrasion resistant, and quick-drying.

In an effort to overcome the shortcomings of 100% cotton fabrics, manufacturers have used blends of cotton and synthetic yarns to produce fabrics with improved durability and shorter drying times. However, the introduction of synthetic fibers into cellulosic fabrics makes it difficult to flame-retardant treat the fabrics. In addition to the flammability of the synthetic fibers, they are also hydrophobic and can, therefore, make it difficult for flame retardant treatments to penetrate yarn bundles. When penetration does occur, the aqueous flame retardant solutions migrate to the surface of yarn bundles more rapidly than with 100% cellulosic (i.e., cotton) fabrics. The rapid drying of cellulosic/synthetic fiber blends is well known. The differences in drying rates and fabric wet-out are the primary reasons why processes that will produce satisfactory results on 100% cotton fabrics will not produce similar results on cotton/synthetic blend fabrics, where the treatment lasts the life of the garment.

Often, it has been found that the synthetic yarns or fibers in these blends tend to melt when exposed to flame, such as from a flash fire. In melting, the synthetic polymers adhere to the skin of the wearer of the garment, causing intense discomfort to the wearer. To minimize the risk of this problem occurring, manufacturers have sought to limit the amount of synthetic material used in flame retardant fabrics (as described, for example, in U.S. Pat. No. 5,480,458 to Fleming et al.) or have used different chemical treatments to apply flame retardant chemicals to both the cellulosic and synthetic components of the fabric (as described, for example, in U.S. Pat. No. 4,732,789 to Hauser et al.).

The present disclosure describes flame retardant fabrics having a synthetic content of at least 30% and a cellulosic content of at least 45%, where the fabrics have been treated with a flame retardant chemical and/or coated with a flame retardant coating. Such fabrics exhibit excellent flame retardance, while maintaining fabric strength, flexibility, and durability. Additionally, the flame retardant chemicals and/or coatings are also durable over repeated washings (even as many as 25 washes at 140° F.). Such fabrics and treatments represent advances over the prior art technology in this field.

SUMMARY

Provided herein are several inventive fabrics having warp yarns and fill yarns, where the warp yarns are preferably an intimate blend of synthetic and cellulosic fibers and where the fill yarns are preferably a repeating pattern of cellulosic yarns and filament or textured filament synthetic yarns. Such fabrics possess sufficient cellulosic content (that is, greater than 45% by weight) to be easily rendered flame retardant, while simultaneously possessing sufficient synthetic content (i.e., greater than 30% by weight) to be abrasion resistant and long-lasting.

In one embodiment, the subject fabrics are treated with one or more flame retardant chemicals, typically in the presence of ammonia gas. In a second embodiment, the subject fabrics are coated on one side with an elastomeric composition into which a flame retardant compound has been incorporated. In yet another embodiment, the subject fabrics are both treated and coated to achieve flame retardance.

DETAILED DESCRIPTION

The term "cellulosic" refers to fibers, yarns, and fabrics made of, or derived from, cellulose. The most common example is cotton and, as such, cotton will be the primary focus of the present disclosure. However, it is to be understood that fabrics made from other cellulosic materials, such as rayon (regenerated cellulose), acetate (cellulose acetate), and triacetate (cellulose triacetate), may all benefit from the chemical treatments provided herein.

The term "synthetic" refers to fibers, yarns, and fabrics that are chemically produced, such as polymers synthesized from chemical compounds. Examples include, without limitation, polyamides (nylon), polyester, polyethylene, polypropylene, polyvinyl, and acrylic. Particularly preferred, for the end uses contemplated herein, are nylon yarns, although acceptable results may also be achieved with polyester yarns.

The weight percentages of cellulosic yarns and synthetic yarns contribute significantly to the success of the fabric in meeting flammability requirements. Preferably, the weight percent of cellulosic yarns is at least 45%; more preferably, at least 50%; most preferably, at least 60%. Preferably, the weight percent of synthetic yarns is at least 30%; more preferably, at least 40%; and most preferably, between 45% and 55%. It is to be understood that the total weight percentages of the cellulosic and synthetic yarns should equal 100%. Particularly useful combinations have been found to be 40% synthetic/60% cellulosic, 52% synthetic/48% cellulosic, and 50% synthetic/50% cellulosic.

The fabrics contemplated herein are various woven fabric substrates, having a plurality of warp yarns running lengthwise in the machine direction and a plurality of fill yarns running substantially perpendicularly to the warp yarns (i.e., in the cross-machine direction). While any weave construction may be used, the potentially preferred constructions are twill weaves, in which the weave is characterized by diagonal lines produced by a series of floats staggered in the warp direction. A warp-face twill is one in which the floats are produced by the warp yarns, while a filling-faced twill is one in which the floats are produced by the fill yarns. Various twill patterns, such as 2/1, 3/1, 3/2, 4/1, and the like, may all be used successfully to position more cellulosic yarns on a single side of the fabric.

The warp yarns are preferably an intimate blend of synthetic and cellulosic fibers, and, more preferably, a 50/50 blend of synthetic and cellulosic fibers by weight. The warp yarns are preferably spun yarns. Blends of nylon and cotton fibers are well-suited for achieving the flame retardant characteristics sought herein. It is to be understood that other warp constructions may also be used, including warps having alternating filament synthetic and cellulosic yarns (as described below) or having alternating intimate blended yarns and filament synthetic yarns, so long as the relative content of the cellulosic and synthetic components falls within the above-prescribed range. Particularly, the use of a small amount (by weight) of textured filament synthetic yarns in the fabric construction dramatically improves the fabric strength, while the cellulosic content ensures that the fabric will exhibit the desired flame retardant performance.

The fill yarns may be either (i) a 50/50 blend of synthetic and cellulosic fibers in the form of spun yarns, as provided in the warp direction, or (ii) a patternwise arrangement of filament synthetic and cellulosic yarns. The term "patternwise arrangement" refers to a repeating pattern of synthetic and cellulosic yarns, in this case, across the fill. Representative patterns include 1:2 (one synthetic yarn followed by two cellulosic yarns) and 1:3 (one synthetic yarn followed by three synthetic yarns). If should be understood that other patterns may also be used, provided the overall content of the cellulosic and synthetic yarns falls within the desired range. Again, nylon and cotton yarns are preferred for many applications. Filament synthetic yarns (particularly textured filament yarns) are useful in providing desired strength and abrasion resistance in the finished fabric. Additionally, textured synthetic yarns provide stretch or elasticity to the fabric for improved fit, flexibility, and comfort.

Embodiment #1

Ammonia Treatment

In a first embodiment, a cellulosic-containing woven fabric is provided, in which the warp yarns are preferably an intimate blend of synthetic and cellulosic fibers and the fill yarns preferably comprise a patternwise arrangement of filament synthetic yarns and cellulosic yarns. In this instance, the ratio of synthetic yarns to cellulosic yarns in the fill direction is preferably one to at least three (that is, at least three cellulosic yarns should be used for each synthetic yarn), although other patterns may be used to provide the same fiber content in the finished fabric. Preferably, nylon and cotton yarns are used to create a woven fabric.

Once the fabric is woven, it is prepared using traditional textile processes, such as desizing, bleaching, and scouring. If desired, the fabric is then dyed and/or printed. The dyed and/or printed fabric is then treated to obtain flame retardant characteristics, according to the process outlined below.

The preferred flame retardant chemistry for this application is a pre-condensate based on the reaction of tetrakis (hydroxymethyl) phosphonium ("THP") sulfate or chloride with urea. One example of such a compound is sold under the tradename PYROSAN® C-FR (having 72% solids and 10% active phosphorous), available from Noveon, Inc. of Cleveland, Ohio. A phosphorous-based component from the THP compound penetrates within the cellulosic fibers, thereby imparting durable flame retardant properties to the treated substrate.

The optimum add-on level of the flame retardant chemical depends on the fabric weight and construction. Usually, it is preferred to achieve an add-on level of 2.5%-4.0% phosphorous, based on the weight of the untreated fabric. Too little and, ironically, too much flame retardant impair the fabric's ability to meet flammability standards.

Assuming an 85% wet pick-up rate, a typical pad bath to deposit 4.0% phosphorous would include roughly equal parts of water and flame retardant with small amounts of wetting agents, softeners, and buffers (such as sodium acetate). Preferably, to create a stable bath, the components are added in the following order—wetting agent and water, buffer, softener, and flame retardant—with stirring used to effectuate proper combination. The softener selection is especially important; for example, when using PYROSAN® C-FR flame retardant, a polyethylene-based softener sold under the tradename FABRITONE® (available from Emerald Carolina Chemical of North Carolina) is particularly well-suited.

Padding may be done on any conventional equipment, but because of the importance of good penetration, an operation using nip rolls is preferred. After the subject fabric has been dipped into the aqueous bath described above, the fabric is dried to reduce the moisture content to between about 9% and about 20%. Preferably, the moisture content is between about 12% and about 16%. Moisture content may be measured by commercially available moisture meters. If the fabric retains too much moisture (i.e., is "too wet"), deposition of the flame retardant throughout the fabric may be adversely affected. If the fabric does not retain enough moisture (i.e., is "too dry"), surface deposition of the flame retardant may occur, leading to a "frosty" appearance and poor durability.

Drying times and temperatures vary with fabric weight and construction. By way of example, using drying temperatures of 200° F. to 250° F., typical fabrics may be dried in as little as 0.5-1.5 minutes. Any drying equipment may be used, although steam-heated cans or forced hot air ovens may be most preferred.

Next, the fabric is transported through an anhydrous ammoniation chamber having a gaseous ammonia content of at least 70%, where gaseous ammonia flows in a direction counter to the direction of the fabric. Subjecting the fabric to such conditions causes a reaction between the ammonia and the flame retardant chemical, creating an ammoniated flame retardant in which the phosphorous is present as a trivalent phosphine. The temperature of the ammoniation chamber is typically in the range of about 120° F. to about 140° F. and ideally should not exceed 160° F. Preferably, there should be at least three molar parts of ammonia in the chamber for each molar part of phosphorous on the fabric. Dwell times inside the ammoniation chamber are typically very short, on the order of about 10 to about 20 seconds, depending on the fabric weight.

To complete the reaction of the flame retardant chemical within the fabric, the ammoniated fabric should be oxidized to convert the trivalent phosphorous into the innocuous pentavalent form, to remove any residual odor from the cured fabric, and to produce maximum durability of the flame retardant fabric for extended washings. Oxidation may occur in a continuous process (such as by submerging the cured fabric in one or more washboxes) or in a batch process (such as by submerging the cured fabric in a bath, vat, or jet vessel). In a continuous process, the first box should contain an aqueous solution of an oxidizing agent (for example, hydrogen peroxide) and, optionally, a wetting agent and/or surfactant. This solution causes conversion of the phosphine compound mentioned above to a stable and durable pentavalent phosphate compound polymerized within the fabric. In the second wash box, the fabric is treated with a neutralizing solution made of an appropriate concentration of caustic, followed by treatment with hot water at about 120° F. to about 140° F. to remove any residual alkali from the neutralized fabric.

When using a batch process to oxidize the ammoniated fabric, surfactant is added to the oxidizing (e.g., hydrogen peroxide) solution, and the fabric is processed in the bath at about 140 F for between 20 and 30 minutes. The surfactant amount is preferably about 2% of the weight of the cured fabric, and, when hydrogen peroxide is used as the oxidizing agent, it is present in an amount of about 15 pounds of 35% hydrogen peroxide for each 100 pounds of fabric. After oxidation, the fabric is neutralized with an alkaline wash and rinsed thoroughly with hot water, as described above, to remove any residual alkali from the fabric.

Finally, the flame retardant fabric is dried, again using any conventional drying methods, preferably to a moisture content level of less than 5%.

It has been found that the physical properties of fabrics treated with the flame retardant process and chemicals described above are not significantly different than those of untreated fabrics. Further, whereas fabrics having the synthetic content described above typically show poor flame retardance, the subject fabrics (i.e., those having blended warp yarns and a patternwise arrangement of fill yarns) actually show exceptional flame retardance properties, as will be further illustrated in the Examples to follow.

Embodiment #2

Flame-Retardant Elastomeric Coating

In a second embodiment, a cellulosic-containing woven fabric is provided, in which the warp yarns are preferably an intimate blend of synthetic and cellulosic fibers and the fill yarns preferably comprise a patternwise arrangement of filament synthetic yarns and cellulosic yarns. In this instance, the ratio of synthetic yarns to cellulosic yarns in the fill direction is preferably one to at least two (that is, at least two cellulosic yarns should be used for each synthetic yarn), although other patterns may be used to provide the same fiber content. Preferably, nylon and cotton yarns are used to create a woven fabric.

In this embodiment, the desired flame retardant properties are imparted to the subject fabric by means of a flame retardant coating that is applied to one side of the fabric. The coating comprises a thermoset elastomer and a halogenated flame retardant compound (more preferably, an aromatic halogenated flame retardant, and, most preferably, an aromatic brominated flame retardant).

The term "aromatic halogenated compound" refers to a compound having at least one halogen radical (e.g., bromine) covalently attached to an aromatic ring structure. Examples of aromatic brominated compounds include, for example, ethane-1,2-bis(pentabromophenyl); tetrabromophthalate esters; tetrabromobisphenyl A and its derivatives; and ethylenebromobistetrabromophthalimide. Other aromatic halogenated flame retardant compounds, as are known in the art, may be used in place of the brominated compounds listed above. Aromatic halogenated flame retardants used in the coating composition provide excellent heat stability, UV-light stability, and non-blooming characteristics. Optionally, phosphorous, aliphatic halogenated flame retardants, or antimony-based flame retardant compounds may be used in lieu of, or in addition to, the aromatic halogenated flame retardant compound.

The thermoset resins useful in preparing the present coating include, for example, silicone rubber, polyacrylate, polyurethane, vinyl chloride copolymers, vinylidene chloride copolymers, and mixtures thereof. Silicone is the preferred thermoset resin, because of its softness when cured and its high temperature resistance. Preferably, the selected resin is of a self-cross-linking type, meaning that the resin tends to link well to itself, thereby forming a durable coating.

Optionally, a cross-linking monomer may be added to the resin to further enhance the cross-linking of the resin on the fabric. When using acrylate-based resins, suitable cross-linking monomers include, for example, N-methylol acrylamide, N-methylol methacrylamide, acrylic acid, methacrylic acid, divinyl benzene, and other multi-functional acrylate and methacrylate monomers. Alternatively, cross-linking may be achieved through such multi-functional cross-linking agents as epoxy resins, amino resins (such as melamine formaldehyde resin or urea formaldehyde resin), polyisocyanates, polycarbodiimides, and blocked polyisocyanates.

To create the flame retardant coatings contemplated herein, the flame retardant compound must be incorporated uniformly into the resin material. How this is accomplished is dependent upon the type of resin being used. In silicone resins, for example, the flame retardant compound is incorporated directly into one part of a two-part addition-cure system. When using other polymers, a latex-based system is used, where the polymer and flame retardant are added via aqueous dispersions, as will be described below. It should be noted that the flame retardant compound is preferably in the form of a fine powder, having an average particle size of about 2.5 microns, which assists in the uniform distribution of the particles throughout the coating and which minimizes the likelihood of compatibility issues between the resin and the flame retardant compound.

When silicone resins are chosen, it is preferable to use a two-part addition-cure silicone system having "A" and "B" components, which, when added to one another, cure to form a durable coating. In this instance, the "A" and "B" components are each liquid silicone compositions, and no solvents are necessary. To incorporate flame retardant compounds into such systems, it has been found effective to add the FR compound to either the "A" or "B" component of the silicone and then stir the FR compound and silicone component under high shear mixing conditions. Once the two are uniformly blended, the remaining silicone component is added, and the coating composition is ready for application to a fabric.

When a latex-based system is desired, the flame retardant compound is dispersed in water with a wetting agent. The dispersion is then mixed with the selected resin, with a thickener being added to adjust the viscosity of the dispersion. The coating composition is then ready for application to a fabric.

In either silicone- or latex-based coatings, the amount of flame retardant chemical that is incorporated is preferably between about 5% and about 60% by weight of the coating and, more preferably, is between about 10% and about 35% by weight of the coating.

The flame retardant coating is then applied to one side of the fabric using any of a number of different techniques, including, but not limited to, floating knife coating, knife over roll coating, spray coating, impregnation coating, curtain coating, reverse roll coating, transfer roll coating, and screen printing. It has also been found that the present coating composition may be applied by foam coating, in which a foaming agent is incorporated into the composition. The resulting coating has greater porosity than coatings applied using different application methods, providing greater breathability to the fabric (thereby translating to greater comfort for the wearer of a garment made with such fabric). Alternately, coatings applied by any method may be perforated after application and drying to achieve greater fabric breathability.

Preferably, the coating is applied to the side of the fabric having a face comprised mostly of fill yarns. Further, when the fabric is made into a garment, the coated side of the fabric will be adjacent the wearer, and the uncoated side will be the outward-facing side of the garment. The add-on weight of the coating composition to the fabric is preferably between 0.5 oz/yd$^2$ and 3.0 oz/yd$^2$ and, more preferably, is between 0.6 oz/yd$^2$ and 1.5 oz/yd$^2$.

The coating is then dried at a temperature in the range of 60° C. to 200° C. and, more preferably, at a temperature in the range of 120° C. to 180° C., and optionally cured if a cross-linking agent is used.

It has been found that such coatings impart durable flame retardant properties to the subject fabrics, while having no significant adverse effects on the fabrics' flexibility, strength, or hand. Due to the high flame retardant concentration in the coating and the thermoset nature of the resin, the coating layer retains its mechanical integrity without melting, even when the rest of the fabric burns after exposure to fire. Where silicone resins are used, the resulting flame retardant coatings further provide thermal protection to the wearer, because of silicone's high thermal stability and insulative properties.

Finally, because flame retardance is achieved by a coating rather than the selective treatment of the cellulosic yarns, it is possible to use a fabric having a higher percentage of synthetic yarns, which may be desirable for some applications.

Embodiment #3

Ammonia Treatment and FR Elastomeric Coating

In a third embodiment, a cellulosic-containing woven fabric is provided, in which the warp yarns are preferably an intimate blend of synthetic and cellulosic fibers and the fill yarns preferably comprise a patternwise arrangement of filament synthetic yarns and cellulosic yarns. In this instance, the ratio of synthetic yarns to cellulosic yarns in the fill direction is preferably one to at least two (that is, at least two cellulosic yarns should be used for each synthetic yarn), although other patterns may be used to provide the same fiber, content. Preferably, nylon and cotton yarns are used to create a woven fabric.

Alternately, the subject fabrics for this treatment may have warp yarns preferably comprised of an intimate blend of synthetic and cellulosic fibers and fill yarns also comprised of an intimate blend of synthetic and cellulosic fibers. Simply put, the warp and fill yarns may be of the same type. Again, nylon and cotton are preferred fiber types.

In this embodiment, the subject fabric is treated, via the ammonia process, described above to impart flame retardant properties to the cellulosic yarns in the fabric. After the fabric has been treated via this process, the fabric is then coated with a flame retardant coating composition, as described with reference to Embodiment #2. Thus, the treated and coated fabric exhibits flame retardant properties, which originate from both the treated cellulosic yarns and the flame retardant coating.

In each of the embodiments (#1, #2, and #3) described above, the fabric may be dyed and/or printed on the face of the fabric before treating and/or coating to achieve flame retardance. The coating is preferably applied to the back side of the fabric to avoid any adverse effect on the color and/or print on the face side. In one embodiment, a camouflage pattern containing a designed infrared reflectance profile is printed on the fabric before the fabric is treated with the flame retardant composition. The infrared reflectance profile may be achieved by using select colorants (e.g., certain dyes) and/or by adding carbon black or other infrared-absorbing pigments to the dye or print chemistry.

Example 1

A woven nylon/cotton ripstop fabric was produced having about 52% nylon content (by weight) and about 48% cotton content (by weight). The warp and fill yarns were spun yarns made of an intimate blend of 52% nylon and 48% cotton. There were approximately 104 ends in the warp direction and approximately 52 picks in the fill direction. The fabric weight was about 6.5 oz/yd$^2$. The fabric was printed on one side with a camouflage color pattern, using a mixture of acid dyes, vat dyes, and a small amount of carbon black pigment to provide a military-grade infrared reflectance profile on the face side of the fabric.

The back side of the fabric was coated with a flame retardant coating composition having the following components:

| | |
|---|---|
| Addition platinum-cure silicone resin, "A" part (sold under tradename LR 6294 by Wacker Chemicals) | 35 parts by weight |
| Addition platinum-cure silicone resin "B" part | 35 parts by weight |
| Ethane-1,2,-bis(pentabromophenyl) (flame retardant; sold under the tradename SAYTEX ® 8010 by Albemarle Corporation) | 30 parts by weight |

The coating composition was applied by floating knife scrape coating at an add-on level of about 1.5-2.0 oz/yd$^2$. The coated fabric was then dried in an oven at about 360° F. for about 3 minutes. The resulting coated fabric was very pliable.

Example 2

The same fabric used in Example 1 was used in Example 2. However, before application of a coating, the fabric was subjected to ammonia treatment.

Following ammonia treatment, the fabric was coated on the back side of the fabric (i.e., the side that was not printed) with the coating composition described in Example 1 and cured. This fabric was also pliable to the touch.

Example 3

The same fabric used in Example 1 was used in Example 3. The fabric was subjected to ammonia treatment, then coated on, the back (non-printed) side with a flame retardant coating composition having the following components:

| | |
|---|---|
| Polyacrylate resin (sold under the tradename APEX ® BINDER 903 by Apexical, Inc.) | 10.1 parts by weight |
| Ethane-1,2,-bis(pentabromophenyl) (flame retardant; sold under the tradename SAYTEX ® 8010 by Albemarle Corporation) | 6.8 parts by weight |
| Water | 1.1 parts by weight |
| Thickener (sold under the tradename CARBOPOL ® PKS by Noveon Corporation) | 0.5 parts by weight |

The coating composition was applied to the fabric by floating knife scrape coating at a dry coating add-on level of about 1.1 oz/yd$^2$. The coated fabric was dried and cured in a 350° F. oven for about 3 minutes.

Example 4

A 2×1 twill fabric having 55.8% cotton content and 44.2% nylon content was produced. The warp yarns were spun yarns made of an intimate blend of 52% nylon and 48% cotton. The fill yarns were a patternwise arrangement of a single textured filament nylon pick and two cotton picks. There were approximately 84 ends in the warp direction and approximately 45 picks in the fill direction. The fabric weight was about 6.0 oz/yd$^2$. The fabric was printed on the face side with a camouflage pattern having a military-grade infrared reflectance profile, as described in Example 1.

The fabric was subjected to ammonia treatment. Following ammonia treatment, the fabric was coated on the back (non-printed) side with the coating composition described in Example 1 and cured. The fabric was pliable to the touch.

Example 5

A 2×1 twill fabric having 59.8% cotton content and 48.2% nylon content was produced. The warp yarns were a 50/50 intimate blend of nylon and cotton spun yarns. The fill yarns were a patternwise arrangement of a single textured filament nylon pick and three cotton picks. There were approximately 88 ends in the warp direction and approximately 43 picks in the fill direction. The fabric weight was about 6.0 oz/yd$^2$. The fabric was printed on the face side with a camouflage pattern having a military-grade infrared reflectance profile, as described in Example 1.

The fabric was coated on the back (non-printed) side with the coating formulation of Example 1, using the same application method, add-on level, and drying temperature and time.

Example 6

The same fabric used in Example 5 was used in Example 6. The fabric was subjected to ammonia treatment, then coated on the back side with the flame retardant coating composition of Example 3.

Evaluation of Example Fabrics

The Examples were evaluated for flame retardance by testing according to ASTM D6413 method, entitled "Standard Test for Flame Resistance of Textiles (Vertical Test)". In this test, the fabric is suspended vertically, and a source of ignition (i.e., a flame) is positioned at the bottom of the fabric for a time of 12 seconds. The flame is removed, and the sample is monitored for "after-flame" (how long the fabric continues to burn) and char length (how far the flame spreads up the fabric). The results are shown below.

| Sample ID | After-Flame Time (seconds) | Char Length (inches) |
|---|---|---|
| Example 1 | 10 | 5 |
| Example 1, after 25 washes at 140° F. | 10 | 5 |
| Example 2 | 0 | 4.5 |
| Example 3 | 0 | 4-5 |
| Example 3, after 25 washes at 140° F. | 0 | 4-5 |

-continued

| Sample ID | After-Flame Time (seconds) | Char Length (inches) |
|---|---|---|
| Example 4 | 0 | 3.6 |
| Example 5 | 10 | 4 |
| Example 6 | 0 | 4.5 |
| Example 6, after 25 washes at 140° F. | 0 | 4.5 |

In Example 1, the burned swatch exhibited very little char or damage on the silicone-coated side. In addition, there was no sign of the synthetic fiber melting on the silicone-coated side. Thus, the coating composition provided excellent protection against burning and against nylon fiber melt.

Also, after the Example 1 fabric was washed 25 times at 140° F., the fabric was checked to assess the condition of the coating composition. The coating composition showed no visually apparent signs of coating degradation, due to the laundering process. Further, the flame resistance test data indicates that the coating is durable to laundering. Similar durability was seen in the fabrics of Examples 3 and 6.

Accordingly, the present treatment and/or coating methods provide durable flame retardance to fabrics having at least 30% synthetic content and at least 45% cellulosic content. For these reasons, the flame retardant fabrics represent an advance over the prior art.

We claim:

1. A flame retardant fabric, said fabric comprising:

a first plurality of yarns in a first direction and a second plurality of yarns in a second direction substantially perpendicular to said first direction, wherein at least one plurality of yarns comprises a patternwise arrangement comprising a repeating pattern of synthetic filament yarns and spun yarns, said spun yarns comprising cellulosic fibers; and wherein said fabric has a cellulosic fiber content of at least 45% by weight of said fabric and a synthetic fiber content of at least 30% by weight of said fabric; and wherein said cellulosic fibers have a pentavalent phosphate compound polymerized therein.

2. The flame retardant fabric of claim 1, wherein said fabric is a woven fabric having warp yarns and fill yarns.

3. The flame retardant fabric of claim 2, wherein said first plurality of yarns are warp yarns, said warp yarns are spun yarns comprising an intimate blend of said cellulosic fibers and said synthetic fibers.

4. The flame retardant fabric of claim 2, wherein said second plurality of yarns are fill yarns, said fill yarns comprising said patternwise arrangement, wherein said patternwise arrangement comprises a repeating pattern of a synthetic filament yarn and at least three cellulosic yarns.

5. The flame retardant fabric of claim 4, wherein said synthetic filament yarn is textured.

6. The flame retardant fabric of claim 1, wherein said woven fabric has a twill construction.

7. The flame retardant fabric of claim 1, wherein said cellulosic fibers are cotton and said synthetic fibers are nylon.

8. A flame retardant fabric, said fabric comprising:

a first plurality of yarns in a first direction and a second plurality of yarns in a second direction substantially perpendicular to said first direction, wherein said fabric is a woven fabric having warp yarns and fill yarns, wherein said first plurality of yarns are warp yarns and said second plurality of yarns are fill yarns, said warp yarns being spun yarns comprising an intimate blend of cellulosic fibers and synthetic fibers, said fill yarns defining a patternwise arrangement comprising a repeating pattern of a synthetic filament yarn in combination with at least two spun yarns comprising cellulosic fibers; and wherein said fabric has a cellulosic fiber content of at least 45% by weight of said fabric and a synthetic fiber content of at least 30% by weight of said fabric; and wherein said cellulosic fibers have a pentavalent phosphate compound polymerized therein.

9. The flame retardant fabric of claim 8, wherein said synthetic filament yarn is nylon.

10. The flame retardant fabric of claim 8, wherein said at least two spun yarns are cotton.

11. The flame retardant fabric of claim 8, wherein said synthetic filament yarn is textured nylon and wherein said at least two spun yarns are cotton.

12. A flame retardant fabric, said fabric comprising:

a first plurality of yarns in a first direction and a second plurality of yarns in a second direction substantially perpendicular to said first direction, wherein said fabric is a woven fabric having warp yarns and fill yarns woven in a twill construction, wherein said first plurality of yarns are warp yarns and said second plurality of yarns are fill yarns, said warp yarns being spun yarns comprising an intimate blend of cellulosic fibers and synthetic fibers, said fill yarns defining a patternwise arrangement comprising a repeating pattern of a textured nylon filament yarn in combination with at least two spun yarns consisting essentially of cellulosic fibers; and wherein said fabric has a cellulosic fiber content of at least 45% by weight of said fabric and a synthetic fiber content of at least 30% by weight of said fabric; and wherein said cellulosic fibers have a pentavalent phosphate compound polymerized therein.

* * * * *